United States Patent [19]

Gilliom et al.

[11] 4,108,139

[45] Aug. 22, 1978

[54] CONVECTION OVEN

[75] Inventors: John W. Gilliom; Robert H. McFarland, both of Mansfield, Ohio

[73] Assignee: The Tappan Company, Mansfield, Ohio

[21] Appl. No.: 675,958

[22] Filed: Apr. 12, 1976

[51] Int. Cl.[2] ..... A21B 1/00; F24C 1/00; A23C 3/00

[52] U.S. Cl. ..... 126/21 A; 426/523

[58] Field of Search ..... 126/21 R, 21 A, 273 A; 426/523

[56] References Cited

U.S. PATENT DOCUMENTS

| | | | |
|---|---|---|---|
| 3,384,068 | 5/1968 | Perry et al. | 126/21 A |
| 3,667,447 | 6/1972 | Toth et al. | 126/21 A |
| 3,710,775 | 1/1973 | Tamada et al. | 126/21 A |
| 3,831,579 | 8/1974 | Tamada et al. | 126/21 A |
| 3,991,737 | 8/1976 | Del Fabbro | 126/21 A |

*Primary Examiner*—Kenneth W. Sprague
*Assistant Examiner*—Larry Jones
*Attorney, Agent, or Firm*—Maky, Renner, Otto & Boisselle

[57] ABSTRACT

The gas burner and blower powered oven includes a mixing chamber of appreciable length that receives bottom outflow air from the oven and, in general opposition, an input from the burner which includes make-up room air. A substantial flame is produced in the chamber for combusting volatiles in the oven outflow and the latter is mixed in the chamber before proceeding to the inlet of the blower, the latter discharging the hot air into the oven through a multiplicity of holes in a top manifold for downward substantially uniform flow throughout the oven.

31 Claims, 3 Drawing Figures

CONVECTION OVEN

This invention relates to convection ovens for domestic or household use and, more particularly, to improvements in the type of such oven disclosed in U.S. Patent Application Ser. No. 303,325, filed Nov. 3,1972, now abandoned, and assigned to assignee of the present application.

Briefly, the oven of the aforementioned application Ser. No. 303,325, of full standard size, utilizes an essentially downward flow of heated air throughout the space in which the food to be heated or cooked will be supported at selected elevations on racks, broiler pans and other customary oven supports. Such flow is established by blower forced discharge of the air substantially uniformly through and over the area of the top of the cooking chamber and withdrawl or exhaust of the air at the bottom part of the chamber for return to the inlet side of the blower and hence recirculation. The heat energy source, of gas or electric nature, is located outside the chamber and at such placement in the air circulation system that air withdrawn for recirculation is both exposed to the heat source and mixed with a predetermined amount of additional or make-up room air to be heated by the source before the mixture flows to the suction side of the blower. The make-up air is balanced by venting a corresponding amount of the flow at the other side of the blower and, preferably, directly from the cooking chamber.

The described circulation system is distinguished by the noted character of the flow of the heated air through the cooking space, and the particular location of the heat source is very important to proper operation of the oven. Since various cooking operations that will be performed, such as broiling and roasting, introduce into the air stream matter given off by the food as it cooks, especially grease, this matter must be eliminated efficiently and promptly. It would otherwise not only contaminate the flow, but present opertional and safety hazards by deposit on the various surfaces containing the recirculation and, of course, notably the blower or impeller. It is preferred to accomplish this scrubbing of the particulate-laden air wholly or in major part by directing the same into close proximity to the heat source for combustion thereof.

As will appear, the above characteristics of the earlier oven disclosed in the aforementioned patent are retained in the new oven of the present invention, and it is in such common respects that this class of oven is distinguished from those shown in recently granted U.S. Pats. Nos. 3,710,775, 3,812,837 and 3,828,760. The first two patents relate to the same hot air cooking oven, with the second differing from the first apparently only by the addition of an oven vent to the original construction. In this oven, an entirely different approach is taken by establishing a front to rear flow of the hot air through the heating or cooking compartment, with a centrifugal impeller having its eye or inlet located behind a central opening in the rear wall of the compartment and ductwork carrying its discharge forwardly exteriorly over inner walls or partitions fully to the open front of the compartment for entry to the same. Another wall or baffle extends fully and solidly across the bottom half of the rear compartment wall to form a vertical chamber that communicates with the impeller opening; in the complete vented form of this oven, there is an external bottom burner box to which combustion and make-up air are delivered and flow through the vertical oven manifold directly to the eye of the impeller. Air and gases from the oven likewise proceed directly to the blower eye, and it is only within the latter that the two air flows are comingled or mixed.

U.S. Pat. No. 3,828,760 discloses an oven unit in a counter top configuration, and it teaches still another type of forced circulation of heated air through the cooking space illustrated and described as a central vortex ascending from the floor or bottom of the oven to the top. This cyclic turbulent pattern, with such central vortex, is created by a baffled and horizontally disposed centrifugal blower just below the over top that recirculates the air in cyclone fashion interiorly down the walls of the compartment and having the top baffle centrally apertured at the blower inlet to draw the air upwardly. The heat source, in this case an electric heating element, is arranged about the blower, and a screen is disposed over the baffle aperture to entrap particulate matter in the recirculated air. Some small holes are formed in the blower baffle to permit limited radiant heat from the resistance heating element to enter the cavity for the browning of some foods, but broiling as well as roasting are accomplished in the floor rack position, that is, with the food rack at the lowest possible level and approximately on the bottom of the oven.

The contemporary patents, and assignee's U.S. Pat. No. 3,973,551, thus teach fundamentally different approaches for domestic convection ovens, and still another is contained in U.S. Pat. No. 3,384,068. The last, however, is not believed to require particular comment here since the instant invention, as indicated, utilizes the same basic operational principles. More particularly, applicants herein have been concerned with the blower system in this class of convection oven and the mixing of the recirculated and make-up air for improved efficiency.

It is, for example, a primary object of the present invention to provide better balance of the recirculated air flow over the heat source and this, more specifically, is accomplished by altering the manner in which the oven air is re-exposed to the source for reheating.

Another principal object concerns improvement in the manner in which the recirculated air is mixed with the newly heated make-up air and the resultant flow delivered thoroughly mixed to the blower for discharge by the latter into the heating space.

It is also an object of the present invention to enhance the combustion-elimination of grease and other volatiles on the air withdrawn from the oven during a cooking operation for the reasons discussed in the foregoing.

In more particular terms, it has been found in this invention that collection and containment of the flow from the oven for recirculation to the heat source, such as a gas burner, provides more controlled balance of this flow than does direct or substantially direct dispersed feed of the former to the latter. Similarly, the provision of the mixing chamber to be disclosed ahead of the blower, at its inlet side, affords better control of the comingled flows of recirculated and heated room air.

In the preferred gas burner embodiment of the invention, the desired elimination of grease and the like is provided by establishing a substantial flame presence in the mixing chamber, and the outflow from the oven, because it has first been collected and contained, can and does form a controlled further input to the mixing chamber in substantial opposition to the burner. The exposure of such outflow to the burner is thereby very efficient, as is the mixing of the two inputs at different temperatures that together are supplied to the blower for circulation through the heating chamber.

Other objects and advantages of the present invention will become apparent as the following description proceeds.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principle of the invention may be employed.

Figure 1:
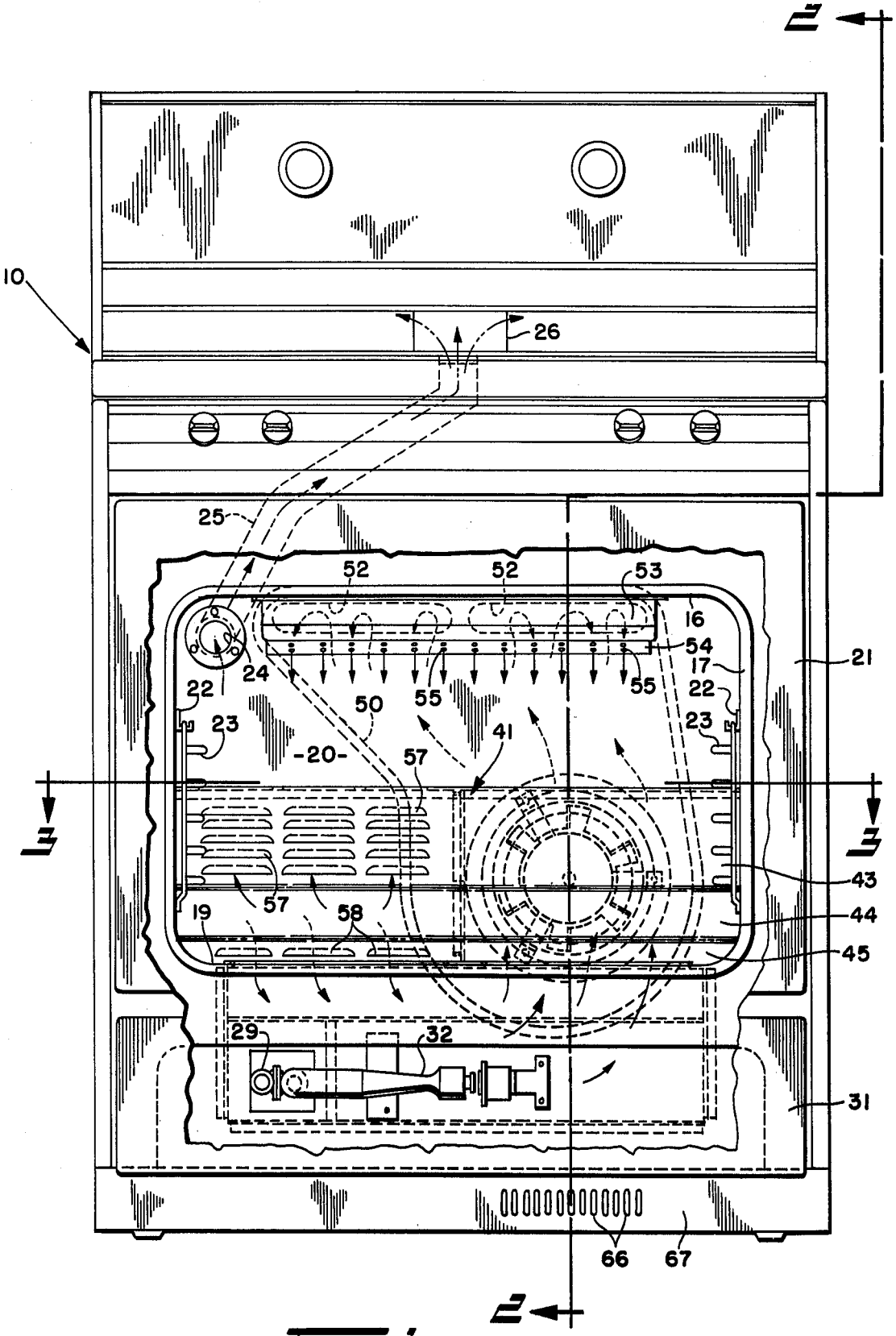
FIG. 1 is a front elevation of a range including an oven in accordance with the presnt invention and with the front range structure broken away to expose the oven cavity and its substructure.

Referring now to the drawings in detail, the range 10 illustrated is obviously of common free-standing type. It is a gas range and, in general respects, it need only be noted that the oven to be described in detail is capable of pyrolytic or high temperature self-cleaning, which accounts for the heavy glas wool insulation that appears and parts of a system for locking the door closed while the oven is being operated in its high temperature mode.

Figure 2:
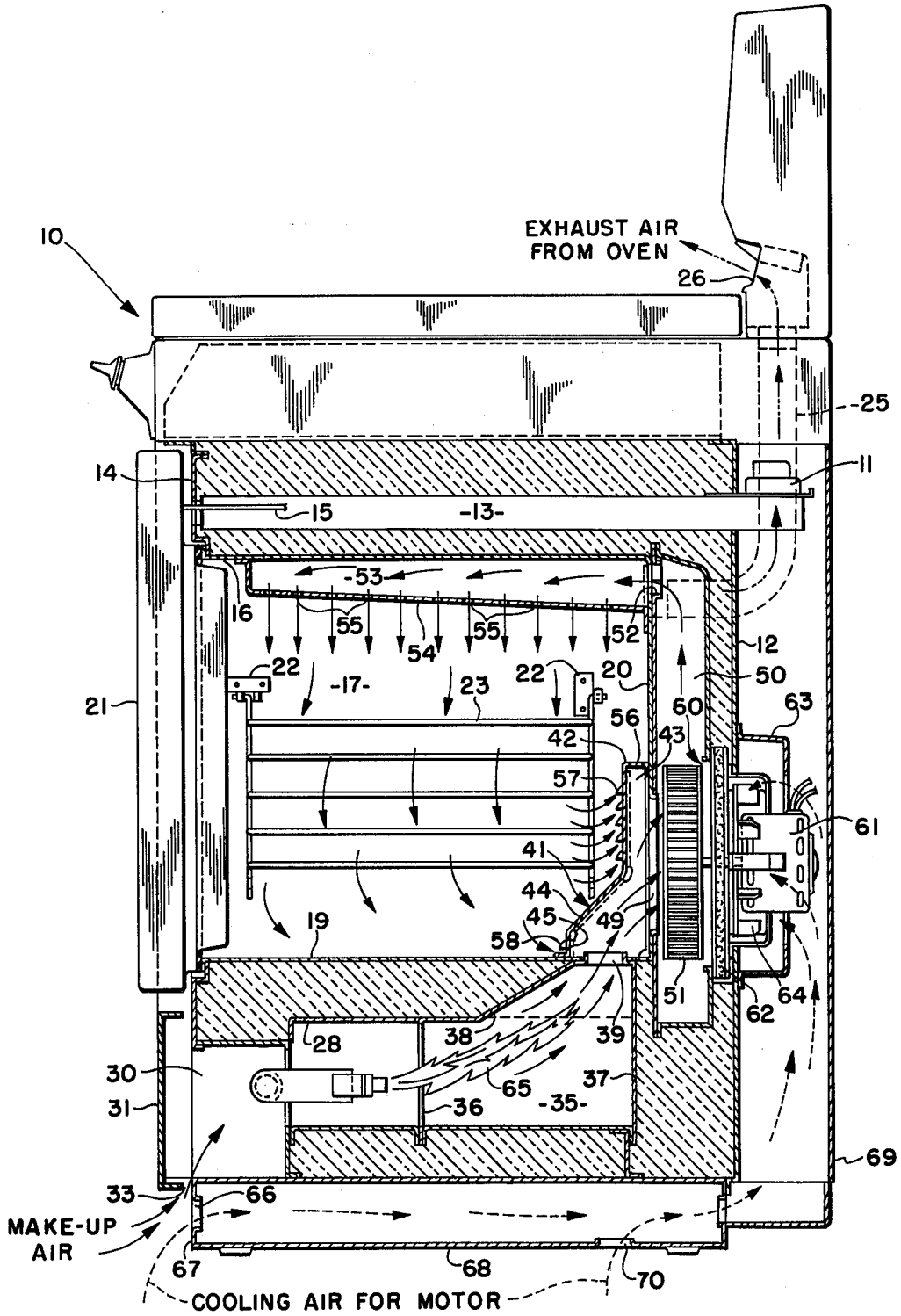
FIG. 2 is a stepped vertical sectional view indicated by the line 2—2 in FIG. 1.

Such parts include, in FIG. 2, an electrical motor 11 mounted at the rear of the outer insulation-containing liner 12 for the oven and a channel 13 extending from the motor through the insulation to the front frame 14 about the oven inner liner to accommodate a motor-operated door lock actuator 15. This particular door locking mechanism is fully disclosed in U.S. Pat. No. 3,875,372, forms no part and is not in any way particularly related to the invention, being included only as a matter of illustration.

The new oven, since it has the capability of pyrolytic self-cleaning action or operation, is of drum formation in that its top wall 16, side walls 17 and 18, and bottom wall 19 are all of one piece. A separate back wall 20 is applied and the front is open as usual for sealed closure by the door 21. The side walls 17 and 18 are provided with hangers 22 from which racks 23 depend to support at selected elevations the usual racks found in any oven for support, in turn, of various utensils in which foods are normally heated or cooked in an oven. As will be further discussed below, the oven has a vent opening 24, shown at the upper left corner region of the back wall, with a conduit 25 leading from such opening to a discharge or exhaust opening 26 provided in the backguard portion of the range.

The heat source is a gas burner 27 contained within a burner box 28 that is located beneath the oven cavity at one side of the same, the left as viewed from the front, with some of the thermal insulation between the two. The burner has a flare tip, FIG. 3, and its ignition in the llustrated embodiment is accomplished by an electric igniter 29, the details of which are not necessary to understanding of the invention.

The burner box 28 is open at the front where there is a transversely extending compartment 30 open at the front behind the lower front trim panel 31 of the range. The burner venturi tube 32, curved as shown, is disposed in this front bottom compartment or recess, together with the gas supply components and the controls for the same as well as the igniter. More significantly, for present purposes, clearance 33 is provided between the front range bottom panel 31 and the body of the range to permit inflow of ambient or room air to the burner box, as shown by arrows and legend in FIG. 2, with this air supporting combustion of the gaseous fuel at the burner and, moreover, providing a predetermined inflow of make-up air likewise to be delivered to the burner, heated by the same and introduced into the forced air circulation system of the oven as will be further discussed in the following.

The burner is directed rearwardly and its box is open at the rear to a mixing chamber 35 that extends transversely relative to the oven for substantially the full width of the same. As best shown again in FIG. 2, this mixing chamber has a body portion of generally rectangular form, with front and rear vertical walls 36 and 37, respectively, and the burner box is almost fully at the left end of the front wall 36.

The rear wall 37 of the mixing chamber continues vertically upwardly to the bottom wall 19 of the oven, while the front wall 36 has an angled continuation 38 the major part of which is inclined rearwardly and also upwardly to the oven bottom. At the thus formed top outlet of the mixing chamber, there are two elongated openings 39 and 40 bounded by flanges that project slightly through corresponding openings in the oven bottom, with these being of the same size, symmetrical with respect to center, and of such length as to extend respectively over almost half of the oven bottom closely adjacent the oven rear wall 20.

A specially formed housing, designated generally by reference numeral 41, is mounted across the bottom rear of the oven and comprises a relatively narrow top 42, a vertical top part 43, a forwardly and downwardly inclined contiguous front wall section 44, and a bottom vertical flange 45 or short wall secured at its bottom edge to the oven bottom 19. This full oven width housing is equally divided into right and left compartments 46 and 47 by a solid central vertical partition 48, and it will be seen that its relatively enlarged bottom section encloses the right and left openings or ports 39, 40 of the mixing chamber 35 respectively in the compartments 46 and 47. Behind the right housing compartment 46, the rear wall 20 of the oven has a circular opening 49 to a blower housing 50 arranged against the exterior of such wall. The blower housing is of the shape shown in FIG. 1 and has upwardly enlarged section extending to the top of the rear wall of the oven. A centrifugal blower 51 is mounted in the lower housing section, with its inlet approximately coincident with the rear wall aperture 49, and the top of the oven rear wall has two horizontal racetrack openings 52, each of substantial length, enclosed by and thus in communication with the top of the blower housing 50.

Mounted against the oven top wall 16, at the interior of the same, is a manifold 53 that extends from the rear wall, enclosing the openings 52, almost fully to the front of the oven, the manifold width being such that its bottom 54 extends substantially fully over the cooking space or area within the oven. Such bottom has a forward upward inclination, so that the transverse cross-section of the mainfold decreases a predetermined degree in its rear to front extent, and the bottom is provided with a uniformly dispersed multiplicity of holes or perforations 55 that provide communication, and the only egress, from the manifold to the top interior of the oven.

The left compartment 47 of the bottom rear housing is, more specifically, a recirculation collector for the oven and, for this purpose, the walls of only this half of the housing are provided with various openings. The latter include, in the illustrated embodiment, top wall slots 56, a series of louvered openings 57 in the front top vertical wall section, and some additional louvered slots 58 across the front lower wall section. As has already been pointed out, this collector compartment within the housing encloses the left oven bottom opening 40 of the mixing chamber 35.

What has been described so far, including the oven vent and the supply of make-up air, with the two operationally balanced, comprises the forced circulation system of the oven thermally powered by the gas burner and convectively by the blower. The latter is mounted on a shaft that extends to the rear through an enlarged opening 60 in the blower housing to an electric drive motor 61 at the back of the outer liner of the oven. The opening is large to permit insertion and removal of the blower, but is closed about the shaft by a removable and thermally insulated plate assembly 62 that also supports the motor mount. The motor is partially enclosed by a housing 63 attached to the rear of the outer liner, with a substantial rear wall opening and open sides as well.

Figure 3:
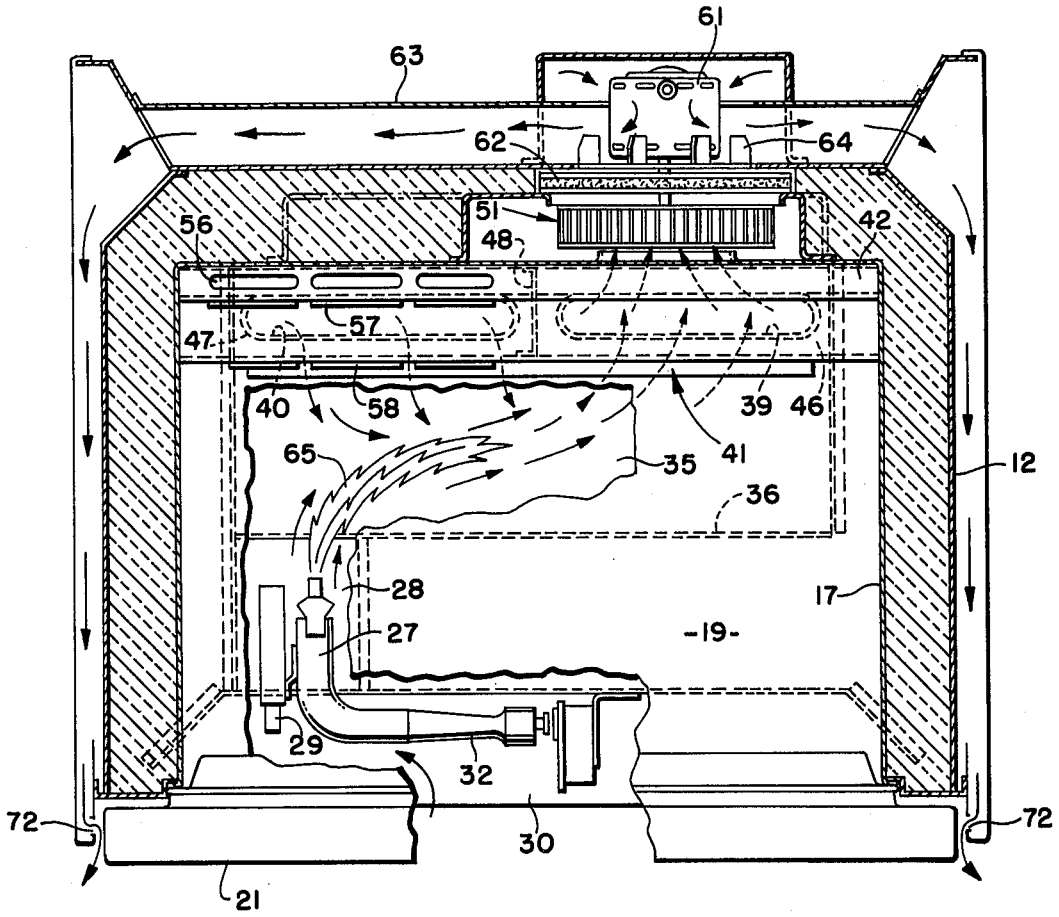
FIG. 3 is a horizontal section through the oven as viewed from the plane of the line 3—3 in FIG. 1.

Since the blower shaft will, nevertheless, become very hot during operation of the oven, its motor support bearing requires special attention, and the shaft is shown as provided at the bearing end with a spider having a number of inclined vanes 64 spaced about the same. This vane ring or spider is driven by the shaft and is operative to pull in the room air through slots 66 in the toe plate 67, and also under the main base 68 through openings 70 therein for circulation about and through the motor for cooling. The cooling air passing over the blower motor 61 travels across the exterior sides of the outer oven liner 12 and then exits through slots 72 into the space between the door 21 and outermost range sides, as best shown in FIG. 3. It will be appreciated that this motor air cooling system is completely separate and isolated from the circulation through the oven cooking cavity.

Such oven circulation system can now be traced in operation, referring also to the air flow arrows included in the drawing, as commencing with driving the blower or fan and igniting the gas burner. The burner flame 65 is directed from the front into the left end portion of the mixing chamber 35, and the burner configuration together with suction created at the center of the blower provide a long torch-lie flame that bends an appreciable distance into and along the length of the mixing chamber, with some upward impetus, as illustrated. Considering only the combustion products of the burner, and the excess of room air that flows as make-up air through the burner box, this flow proceeds from the right hand section of the mixing chamber, through the oven bottom opening 39 and the right compartment 46 of the housing 41 to the center or eye of the blower 51. As forcibly discharged by the blower, the flow continues upwardly over the rear wall of the oven through the expanding blower housing 50 to enter the oven top manifold 53 through the rear wall openings 52.

The heated air and gases are discharged from the manifold downwardly through holes 55 into the oven, with the forwardly tapered form of the manifold assisting to maintain the discharge substantially uniform from the back to the front, so that the useful rack area in the oven is downwardly traversed by the hot air to the bottom portion of the oven. A determined quantity of flow will, of course, be bled off or exhausted through the oven vent 24, while the major portion by far of the heated air in the oven is withdrawn through the collector section 47 of the bottom rear housing 41 and returns to the mixing chamber 35 through the left oven bottom opening 40, generally opposite the burner housing. Such outflow from the oven thus becomes a recirculation flow that is almost immediately drawn into the burner flame and the make-up air supplied through the burner box. The two flows, obviously at different temperatures, become well mixed to form a more uniform combined feed to the blower, and continued operation is, of course, repetitive of the foregoing.

It will, furthermore, be obvious that the described arrangement provides extremely efficient burning of grease and other volatiles in the oven outflow well in advance of the blower inlet, and it has been found that it is not necessary in this system to employ grease filters or other additional scrubbing means for the recirculated air.

It will also be appreciated that the controls for the burner and the blower will include some suitable form of door interlock, not shown, so that they cannot operate unless the door is fully closed, with this feature obtaining in all operations of the oven.

The basic advantages of a convection oven, as compared to conventional ovens, are speed and conservation of energy, with the former of course a factor in the latter, but also a significant directly realized benefit for the user. A evidenced by extensive testing, with this new oven it is possible to perform all of the usual oven cooking operations in much shorter times than normally required in conventional ovens, including broiling as well as baking and roasting. Due to such oven design, the heat circulation and efficiency of the oven are much improved over conventional ovens, and as a result it is possible to broil meats at lower temperatures than in a conventional oven. Assignee's prior mentioned patent application Serial No. 303,325 cites a number of specific examples of very appreciable reduction in cooking times for various foods, as well as broiling times, and it is estimated that a gas convection oven can provide an average energy savings on the order of about thirty percent, excluding conventional oven pilot consumption. The new oven herein described provides such advantages as well in a reproducible construction with assured uniform high quality performance.

We claim:

1. In a blower powered convection oven, a blower which receives an outflow of the oven air to be recirculated and an inflow of heated room air for charging the oven, the oven being vented, an air mixing chamber having an inlet portion, a mixing portion and an outlet portion, means providing communication between said outlet portion and the inlet of the blower, means for delivering the oven outflow to the inlet portion of the mixing chamber, and means for delivering the heated room air likewise to said inlet portion, whereby the oven outflow and heated room air are comingled in passage through the mixing portion of the chamber and supplied as a mixture thereof to the inlet of the blower for hot air feed to the oven.

2. In an oven as set forth in claim 1, wherein the oven outflow is confined by collector means for contained delivery of the same to the mixing chamber.

3. The oven as set forth in claim 2, wherein means are provided for introducing the oven outflow and heated room air into the inlet portion of the mixing chamber along substantially immediately intersecting flow paths.

4. The oven as set forth in claim 3, wherein the room air is heated and the oven outflow reheated by direct exposure of such room air and oven outflow to the same gas burner means.

5. In an oven as set forth in claim 4, wherein the gas burner means produces a flame that extends appreciably into the mixing chamber to combust volatiles contained in the oven outflow to be recirculated.

6. The oven as set forth in claim 1, wherein means are provided for introducing the oven outflow and heated room air into the inlet portion of the mixing chamber along substantially immediately intersecting flow paths.

7. The oven as set forth in claim 6, wherein the room air is heated and the oven outflow reheated by direct exposure of such room air and oven outflow to the same gas burner means.

8. In an oven as set forth in claim 7, wherein the gas burner means produces a flame that extends appreciably into the mixing chamber to combust volatiles contained in the oven outflow to be recirculated.

9. The oven a set forth in claim 1, wherein the room air is heated and the oven outflow reheated by direct exposure of such room air and oven outflow to the same gas burner means.

10. In an oven as set forth in claim 9, wherein the gas burner means produces a flame that extends appreciably into the mixing chamber to combust volatiles contained in the oven outflow to be recirculated.

11. In a convection oven including hot air supply means for discharging such air downwardly substantially fully over the top of the oven, air outlet means at the oven bottom, blower means for recirculating the oven air in such downward flow through the cooking space thereof, heating means for reheating the oven air during its flow from said air outlet means to the inlet of said blower means, and means for adding heated room air to the recirculating flow; means for mixing the air from the oven with the heated room air for combined mixed flow of the same prior to entering said blower means, including a separate thermally insulated mixing compartment, means for conducting the oven air to said compartment, means for introducing the heated room air to said compartment in the same region thereof as the oven air entry, said compartment having a separated outlet, and means for flow interconnection of said outlet and the inlet of said blower means, whereby said blower means draws the oven air for recirculation and the heated room air together in mixing flow through said compartment prior to discharge of the mixture into the top of the oven.

12. In an oven as set forth in claim 11, including collector means at a bottom rear part of the oven for containing the oven air as withdrawn for such conduction of the same to the mixing compartment.

13. In an oven as set forth in claim 12, wherein the room air is drawn over the heating means in its delivery to the mixing compartment.

14. In an oven as set forth in claim 13, wherein the heating means is gas burner means within a burner box that communicates directly with the mixing compartment.

15. In an oven as set forth in claim 14, wherein the burner means produces a flame that extends appreciably into the mixing compartment.

16. In an oven as set forth in claim 15, wherein the burner flame is directed toward the entry of the oven air to the mixing compartment.

17. In an oven as set forth in claim 11, wherein the means for conducting the air from the oven to the mixing compartment and the mixture of oven air and heated room air from the compartment to the blower means includes first and second openings at the bottom rear of the oven.

18. In an oven as set forth in claim 17, wherein said first and second oven openings are enclosed by a common divided housing having separate oven air outflow and blower means inlet passages communicating, respectively, with the oven and the inlet of the blower means.

19. In an oven as set forth in claim 18, wherein the heating means is gas burner means having a flame that projects into the mixing compartment.

20. In an oven as set forth in claim 19, wherein the room air is drawn over said burner means for heating the same.

21. In an oven as set forth in claim 20, wherein the burner flame is directed at the inflow of the oven air to the mixing compartment.

22. In an oven as set forth in claim 21, wherein the burner flame extends substantially along the air flow through the mixing compartment.

23. A convection oven comprising housing means disposed transversely against the bottom rear of the oven and defining an enclosure, an intermediate partition forming separate side-by-side compartments within such enclosure, an opening to the exterior of the oven in each compartment, one compartment also having an opening to the interior of the oven and thereby providing for outflow of the oven air through the same, and blower means for supplying air to the oven, the other compartment having an outlet for connection to the inlet of said blower means, whereby oven air withdrawn through said one compartment can be returned through the other for recirculation by the blower means.

24. A convection oven as set forth in claim 23, including means for reheating the oven air outflow in its passage from said one to said other compartment of the housing means.

25. A convection oven as set forth in claim 24, including means for adding a predetermined inflow of room air to the oven air outflow in its such passage.

26. The method of cooking food by forced hot air flow, that comprises the steps of forcibly discharging the hot air against the food, collecting the air after passage over the food and forming a contained flow of the same, forming a smaller separate flow of ambient air, bringing the two such air flows together in a confined space for intermixing of the same while applying heat thereto, and pressurizing the heated mixture to produce the hot air forcibly discharged against the food, the major portion of the hot air used for cooking thus being recirculated.

27. The method set forth in claim 26, including the further step of removing particulate matter entrained in the flow in its passage over the food before it is recirculated.

28. The method set forth in claim 27, wherein the particulate matter is removed by combusting the same by the heat applied to the two air flows during intermixing of the same in such confined space.

29. The method set forth in claim 28, in which the hot air is discharged downwardly for such directional impingement with the food, in such a manner as to permit broiling of meats at lower temperatures than in a conventional oven.

30. The method as set forth in claim 26, in which the hot air is discharged substantially uniformly over the area occupied by the food, with the latter supported generally transversely relative to such discharge.

31. A convection oven for cooking food by forced hot air flow, comprising means for forcibly discharging hot air against the food, means for collecting the air after passage over the food and forming a contained flow of the same, means for forming a smaller separate flow of ambient air, means for bringing the two such air flows together in a confined space for intermixing of the same while applying heat thereto, and means downstream of said confined space for pressuring the heated mixture to produce the hot air forcibly discharged against the food, the major portion of the hot air used for cooking thus being recirculated.

* * * * *